United States Patent [19]

Rösler

[11] 4,046,279

[45] Sept. 6, 1977

[54] PACKING CONTAINER FOR OBJECTS OF VARIABLE LENGTHS

[75] Inventor: Peter Rösler, Berlin, Germany

[73] Assignee: Hilti Aktiengesellschaft, Schaan, Liechtenstein

[21] Appl. No.: 662,264

[22] Filed: Feb. 27, 1976

Related U.S. Application Data

[63] Continuation-in-part of Ser. No. 568,386, April 16, 1975, abandoned.

[30] Foreign Application Priority Data

Apr. 19, 1974 Germany ..... 2418846

[51] Int. Cl.[2] ..... B65D 7/04; B65D 7/30

[52] U.S. Cl. ..... 220/8; 206/349; 206/446; 206/590; 285/303; 285/402

[58] Field of Search ..... 220/8, 288, 300; 285/303, 402; 206/3, 277, 317, 364, 365, 349, 379, 380, 384, 443, 446, 521, 530, 590

[56] References Cited

U.S. PATENT DOCUMENTS

| | | | |
|---|---|---|---|
| 750,632 | 1/1904 | Fisher | 220/8 X |
| 1,189,052 | 6/1916 | Brookshire | 285/303 |
| 1,248,882 | 12/1917 | Mack | 285/402 X |
| 1,268,904 | 6/1918 | White | 220/300 X |
| 1,351,964 | 9/1920 | Drofino | 220/300 |
| 1,447,949 | 3/1923 | Hall et al. | 285/402 X |
| 2,134,908 | 11/1938 | Copeman | 206/521 X |
| 2,202,084 | 5/1940 | Bourland | 220/300 |
| 2,252,132 | 8/1941 | Mazveskas et al. | 285/402 X |
| 2,480,578 | 8/1949 | Hodges | 285/402 X |
| 3,198,321 | 8/1965 | Politano | 220/8 X |

FOREIGN PATENT DOCUMENTS

| | | | |
|---|---|---|---|
| 647,439 | 8/1962 | Canada | 206/521 |

*Primary Examiner*—Stephen Marcus
*Attorney, Agent, or Firm*—Toren, McGeady and Stanger

[57] ABSTRACT

A packing container for elongated objects of variable length is formed of two tubular shaped bodies each closed at one end and open at the other. One of the bodies fits into the other in a telescoping manner. In the telescoped position the inner body has a longitudinal groove extending from its open end with equidistantly spaced locking grooves opening off the longitudinally extending groove. The outer body has one or several inwardly projecting detents formed adjacent its open end. If plural detents are used, they are longitudinally aligned and arranged at the same spacing as the locking grooves. The detents are shaped to pass through the longitudinally extending groove and to fit in an interlocking manner with the locking grooves. By relative rotation of the telescoped bodies about their longitudinal axes, the detents can be moved into the locking grooves and the two bodies locked together at a selected overall length in accordance with the length of the packaged object. The inner body can be provided with surfaces at the openings into the body grooves for the longitudinal groove so that a certain resistance must be overcome in the rotational movement of the detents into and out of the locking grooves.

27 Claims, 9 Drawing Figures

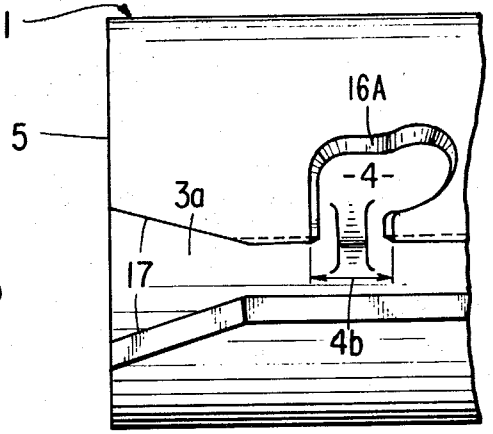
Fig. 7A
Fig. 8
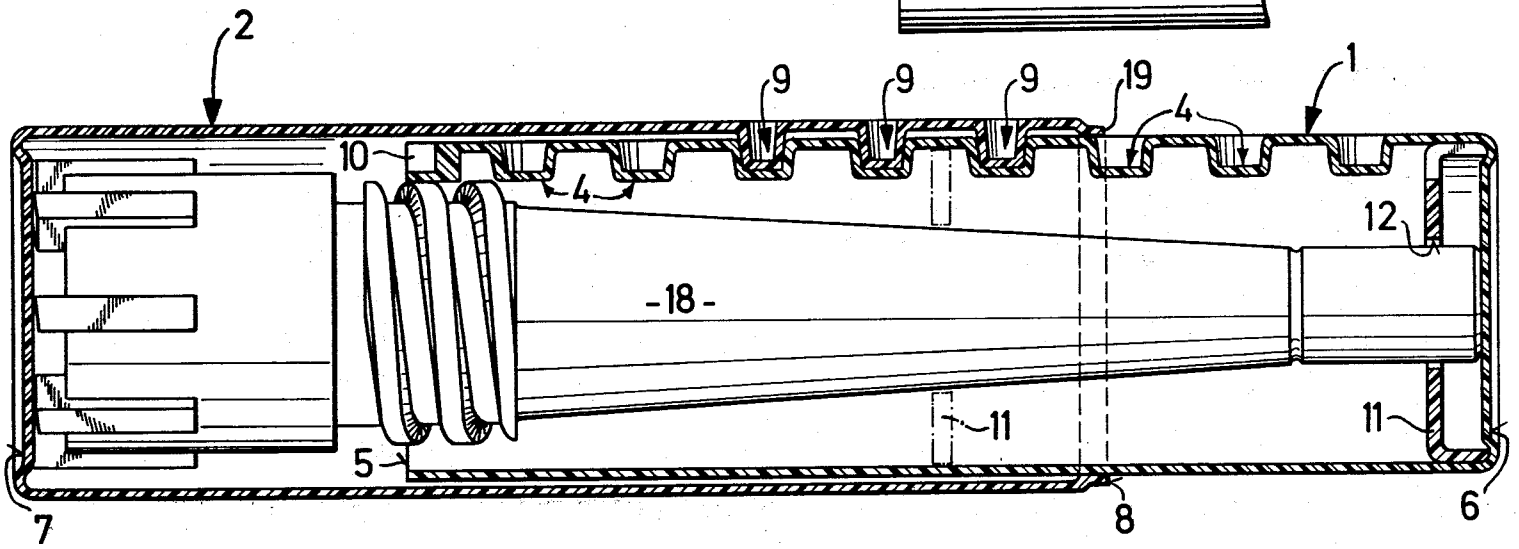

PACKING CONTAINER FOR OBJECTS OF VARIABLE LENGTHS

This is a continuation-in-part of Ser. No. 568,386 filed Apr. 16, 1975, now abandoned.

SUMMARY OF THE INVENTION

The present invention is directed to a packing container for elongated objects and, more specifically, it concerns the arrangement of two elongated hollow bodies each closed at one end and open at the other so that the bodies can be telescoped one into the other and fixed at a variable selected length by relative rotation of the bodies about their longitudinal axes.

If elongated objects of different variable lengths are to be packed in a container so that they perform little or no movement in the longitudinal direction, it is necessary to provide a container corresponding to each of the different lengths of the objects. Such a packaging procedure leads to a plurality of different sized containers each adapted to one of the different lengths of the objects. As a result, not only does the cost of packaging increase, because different molds or tools are required for producing the packing containers, but the cost of stock-keeping is also increased, since a supply of the containers for each length of object to be packaged, must always be available. Another factor which complicates the problem of packaging elongated objects, for instance drills, chisels and the like, is that such objects have larger cross sectional dimensions in accordance with the length of the object, that is, there is a certain ratio between the length and the diametrical dimensions of the object.

To meet the demands for a reduction in the number of container parts of different longitudinal and cross sectional dimensions which must be stocked, it has been known to utilize a container formed of two elongated parts each closed at one end face and with the open end joined together by a threaded arrangement. In such a container one part of a standard size is used for objects within a certain range of dimensions, while the other part is provided in variable lengths with a cross sectional configuration corresponding to the part of standard length. As a result, it is possible to reduce the costs of producing and storing the containers, since only the length of one part needs to be varied within certain limits while the other or standard length part remains unchanged. However, this known container arrangement is still unsatisfactory, because the one part must be provided in a variety of lengths corresponding to the lengths of the objects to be packaged.

If we assume, for example, that drills having lengths of 20 to 40 cm are to be packaged and they have delicate cutting edges which must be protected and there is only slight variation in the diameter of the drills, a container of a constant diameter can be used, however, only one part of the container can remain constant in size while the other part must be provided in a number of graded lengths.

The present invention is directed to the problem of providing a container for use in packaging elongated objects which have a wide length range, where the same parts can be used over the length range of the objects. Accordingly, the same two-part container can be used to package objects where the longest object is about twice the length of the shortest object.

If we assume, for example, that a drill of 35 cm in length must have a container of a corresponding length, the same container should be usable for drills of about twice that length, for example 60 cm in length.

In accordance with the present invention, the problem is solved by providing a two-part container consisting of a first part telescopically movable into a second part so that the outer wall of the first part bears on the inner wall of the second part. The two parts are each closed at one end and open at the other and a groove is formed in the first part extending from its open end parallel to its longitudinal axis. A plurality of locking grooves extend transversely to the axis of the longitudinal groove and the locking grooves are equidistantly spaced apart along the longitudinal groove. At least one inwardly projecting detent is formed on the second part adjacent its open end and is shaped to pass through the longitudinal groove and to fit tightly into the locking grooves.

With such a two-part container the problem of a single container for objects having a range of lengths is solved. Due to the relative displaceability of the two parts one within the other and the provision of a longitudinal groove in one with locking grooves opening from it and the detent in the other part which is movable through the longitudinal groove and lockingly positionable within the locking grooves, it is possible to provide a container whose length can be varied in accordance with the length of the object being packaged. The range of lengths to be accommodated within the container is determined by the spacing between the locking groove closest to the open end of the first part and the locking groove closest to the closed end of the first part.

Preferably, both parts of the container are cylindrical. Further, it is preferably if the longitudinal groove extends from the open end to the closed end of the first part so that the maximum portion of its total length is usable. Accordingly, locking grooves are provided over the entire length of the longitudinal groove and are equidistantly spaced apart. A spacing of 1.5 to 2 cm has been found to be particularly advantageous for the locking grooves.

Though a single detent in the second part of the container may be sufficient, it is advantageous if several detents, preferably three, are used, since the multiple detents afford a better locking action and greater rigidity to the overall container, especially if the two parts are in a telescoped arrangement over only a relatively small length. Furthermore, it is preferable if the detents are circular and more particularly frusto-conical with a steep cone shell angle.

The opening from the longitudinal groove into each of the locking grooves has a width which is preferably equal to or slightly smaller than the diameter of the detent, so that a certain resistance must be overcome in displacing the detents into and out of the locking grooves. Alternatively, a ridge can be formed in the common surface leading from the longitudinal groove into each of the locking grooves to provide the desired resistance or limitation to movement between the grooves. Further, the opening into the locking grooves has a pair of opposed surfaces which preferably are arranged first in converging relationship from the longitudinal groove towards the locking groove and then in diverging relationship into the configuration of the locking groove. As a result, a pair of oppositely arranged apexes are provided in the surfaces of the opening into the locking grooves. Furthermore, an extension can be provided from the locking grooves spaced from and extending parallel to or slightly obliquely to the axis of the longitudinal groove so that the detents can be introduced through the extensions after the relative rotation between the two parts effects the movement into the locking grooves followed by a movement substantially parallel to the longitudinal axes of the container parts about which the rotation takes place.

At its end adjacent the open end of the first part, the longitudinal groove can be dovetailed or it can be provided with a tapering configuration on one side only to facilitate the movement of the detents into the longitudinal groove.

Because of the variation in diametrical dimensions of the objects being packaged, annular disks or spacers can be positioned within the container parts to assure that the object is held against any lateral movement. Such spacing members prevent damage to cutting edges or other surfaces on the objects.

The various features of novelty which characterize the invention are pointed out with particularity in the claims annexed to and forming a part of this disclosure. For a better understanding of the invention, its operating advantages and specific objects to be attained by its use, reference should be had to the accompanying drawings and descriptive matter in which there is illustrated and described a preferred embodiment of the invention.

BRIEF DESCRIPTION OF THE DRAWING

FIG. 7A is a view similar to FIG. 7 but illustrating an alternate embodiment; and FIG. 8 is a longitudinal sectional view through a completely assembled container embodying the present invention and including the packaged object in the container.

DETAILED DESCRIPTION OF THE INVENTION

Figure 1:
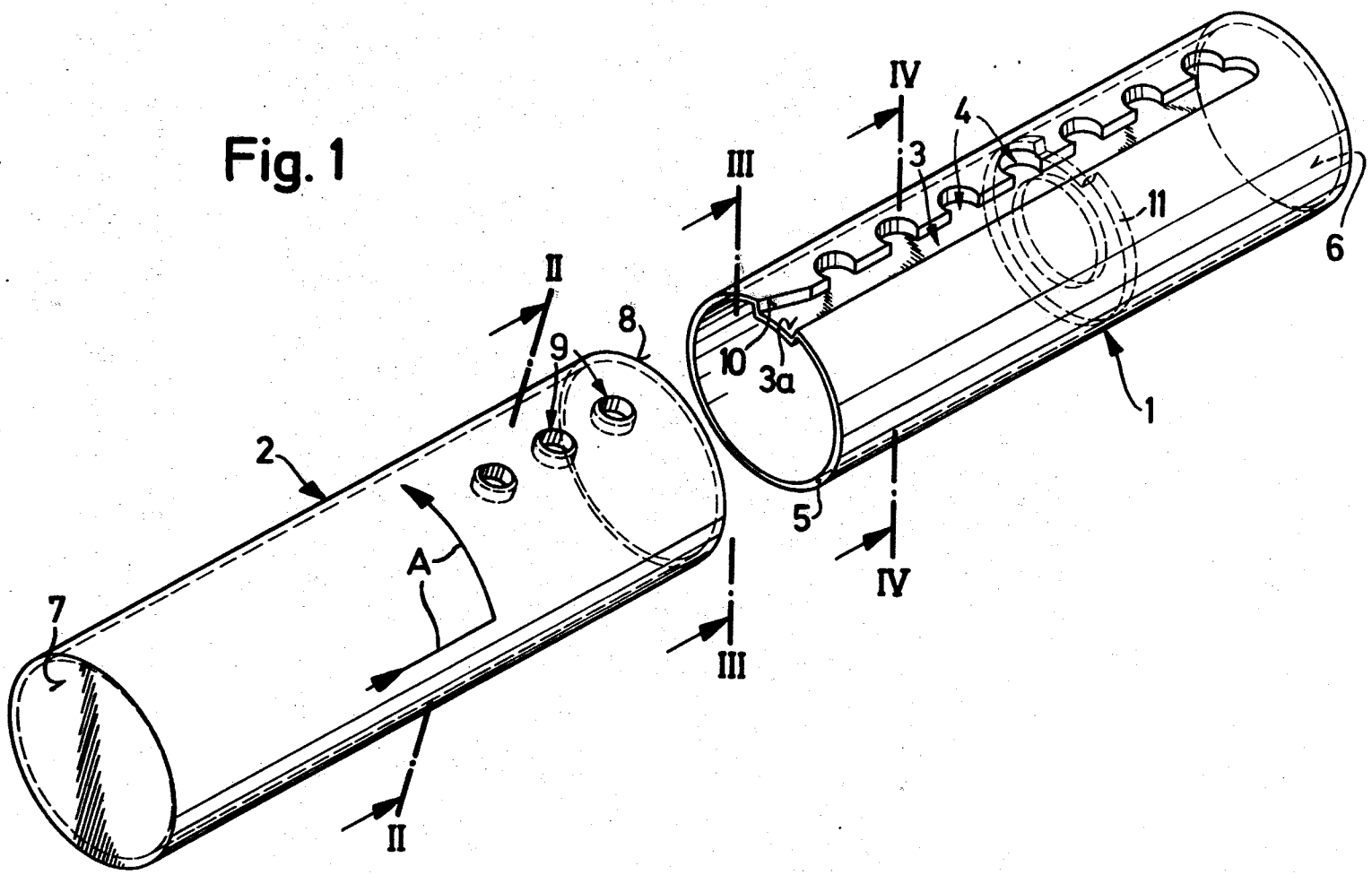
FIG. 1 is a perspective view of two parts of a container embodying the present invention, aligned for movement one into the other.

In FIG. 1 a container embodying the present invention is illustrated consisting of two parts, a first part 1 and a second part 2 with the first part being movably displaceable in a telescoping manner into the second part. In this embodiment, with part 1 telescoped within the second part 2, the outer surface of the first part bears against the inner surface of the second part.

The first part 1 has a longitudinally extending groove 3 of constant depth and width which extends parallel to its longitudinal axis. Extending transversely of the longitudinal groove and equidistantly spaced along its length are locking grooves 4. The locking grooves are similarly shaped and have the same depth as the groove 3 so that a common bottom surface extends between the grooves. As viewed in FIG. 1 the longitudinal groove 3 extends from the open end 5 of the first part 1 to a location adjacent to but spaced from the closed end 6 of the part. The length of the longitudinal groove, or more precisely, the length of the longitudinal groove containing the locking grooves determines the variable length of the container capable of being formed by the two parts 1, 2.

The second part 2 has a closed end 7 and an open end 8. Adjacent the open end 8 three detents 9 are shown projecting inwardly into the second part 2. While a single detent would be sufficient to provide the locking action between the first and second parts, it is preferable to use three detents aligned and spaced apart in the longitudinal direction of the part. The detents 9 have a complementary shape to the longitudinal groove 3 and they are spaced at the same interval as the locking grooves 4. Further, the detents are shaped to fit in locking engagement within the locking grooves. The first and second parts 1, 2 can be secured together in a telescopic manner to form an elongated container closed at its opposite ends. In securing the two parts together the detents 9 are guided within and move through the longitudinal groove 3 until the desired overall length of the container is selected. With the desired length established, the parts 1, 2 are rotated relative to one another about their common longitudinal axis so that there is a relative movement of the detents 9 in the direction of the arrow A, note FIG. 1, for securing the detents into the corresponding locking grooves 4.

Figure 5:
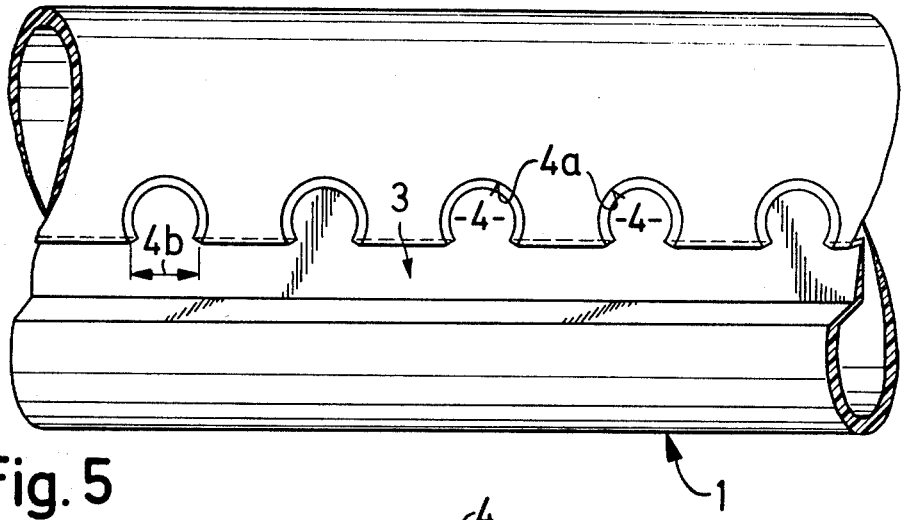
FIG. 5 is a partial top view of that part of the container shown in the right hand end of FIG. 1.

As illustrated in FIG. 1, the detents 9 are circular and the locking grooves have a similar shape for recovering and holding the detents. As shown in FIG. 5, starting from the side or edge of the longitudinal groove 3, each of the locking grooves 4 has a horseshoe-shaped contour. The inlet openings from the longitudinal groove 3 into the locking grooves 4 have approximately the same dimension as the diameter of the detents, however, the opening may be somewhat smaller than the diameter. The dimension of the opening into the locking grooves 4 depends on the material used in forming the container parts. Accordingly, whether the opening into the locking groove is equal to or slightly less than the diametrical dimension of the detents, a certain resistance must be overcome in moving the detents into and out of locking grooves. The opposite surface forming the opening into the locking grooves can be arranged in converging relationship from the edge of the longitudinal groove 3 to a point closely spaced from the longitudinal edge and then the surfaces can diverge again entering into the horeshoe-shaped locking groove. As a result, each of the opposite faces describe an apex-like arrangement forming a restricted opening into the locking groove 4, with the converging surfaces forming a lead-in to the locking groove.

As illustrated in FIG. 1, the inlet end **3*a* of the longitudinal groove 3 at the open end 5 of the first part 1 has a tapered surface 10 on one side while the opposite side is rectilinear in alignment with the remainder of that edge of the longitudinal groove. As an alternative the opposite sides at the inlet end to the longitudinal groove can be similarly tapered so that the inlet end has a dovetailed shape. The inwardly tapering sides of the longitudinal groove at the inlet end facilitate the introduction of the leading detent 9 into the groove when the first part 1 is moved in a telescoping-like manner into the interior of the second part 2**.

Figure 3:
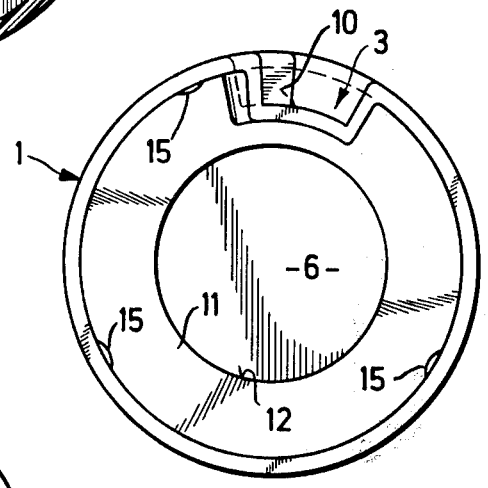
FIG. 3 is an end view taken in the direction indicated by the line III—III in FIG. 1.
Figure 4:
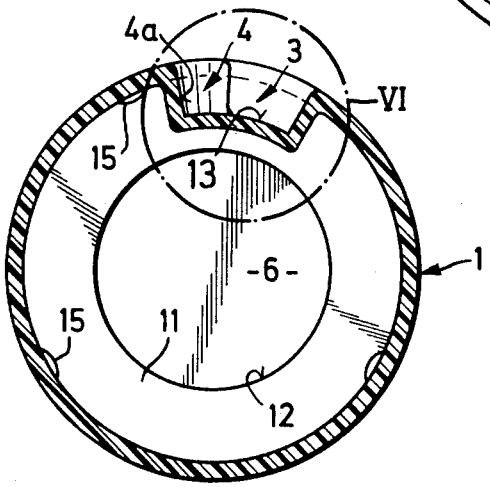
FIG. 4 is a sectional view taken along the line IV—IV in FIG. 1.

At least one disk can be provided within the container having a circumferential peripheral shape adapted to conform to or fit the inner surface of the first part 1 including the longitudinal groove 3 and the locking groove 4, note the disk 11 shown in dashed lines in FIG. 1 and also shown in FIGS. 3 and 4. The disk is annular in shape having a central opening 12 complementary to the outer configuration of the object to be packed. Due to its shape the disk provides a spacer between the outer surface of the object being packed and the inner surface of the first part 1. Accordingly, the object is secured against lateral displacement within the container after its final assembly. As illustrated in FIGS. 3 and 4, lugs 15 are angularly spaced apart on the inner surface of the inner or first part 1 to secure the disk against the displacement.

Figure 2:
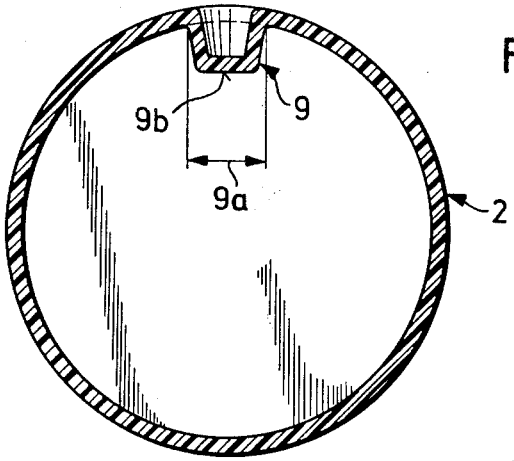
FIG. 2 is a sectional view taken along lines II—II in FIG. 1.

In FIG. 2 a cross section of the outer or second part 2 is shown with the detent 9 extending inwardly. As indicated in FIG. 1, the detent has a circular cross section and, as viewed in FIG. 2, is frusto-conically shaped. The maximum diameter 9*a* of the detent is located at the inner surface of the second part 2. From the inner surface, the detent tapers inwardly and terminates in the circular shaped bottom 9*b*.

In FIG. 3, the first part 1 is viewed looking into its open end, note the line III—III in FIG. 1. At the inlet 3*a* into the longitudinal groove 3 at the open end 5 of the first part 1, the tapered surface 10 can be seen. Within the first part 1, spaced between the open end 5 and the closed end 6, is the annular disk 11 having an outer circumferential peripheral surface contoured to fit exactly with the inner surface of first part 1 including the inner surface of the longitudinal groove 3 and of the locking grooves 4. The opening 12 in the disk is selected in correspondence with the cross sectional shape of the object to be packed. The lugs 15 spaced angularly about the inner surface of the first part hold the disk against displacement.

In FIG. 4, a cross sectional view of the first part 1 is shown in the range of one of its locking grooves, note the section line IV—IV in FIG. 1. It can be seen in this FIGURE that the longitudinal groove 3 and the locking groove 4 have the same depth inwardly from the outer surface of the part so that a common base 13 extends concentrically with the wall of the part 1. The inner contour 4*a*, note also FIG. 5, conforms to the outer contour of the frusto-conically shaped surface of the detent 9. In FIG. 4, the disk 11 with its central opening 12, and the lugs which secure it in place are shown.

Figure 6:
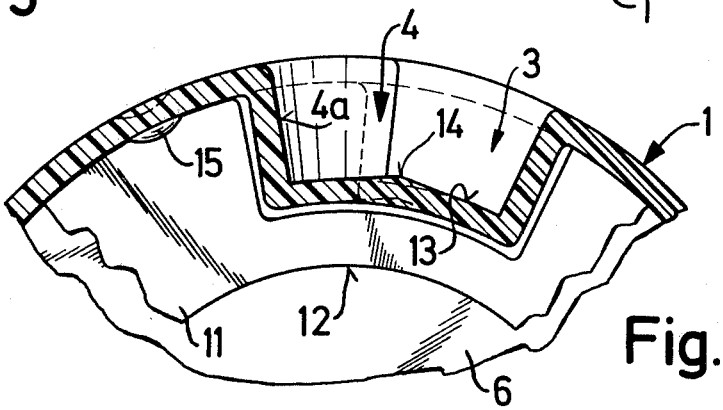
FIG. 6 is an enlarged sectional view of the encircled portion VI of FIG. 4.

The encircled portion of FIG. 4, identified as VI, is illustrated in FIG. 6. In the common base 13 of the longitudinal groove 3 and the locking groove 4, a ridge-shaped projection 14 is provided extending upwardly so that it is in the path of a detent moving between the longitudinal groove 3 and the locking groove 4. The projection 14 consists of tangents extending from the concentrically arranged common base 13 and forming a ridge along the line extending in the axial direction of the part 1 at the opening between the longitudinal groove and the locking groove. The projection 1 extends radially outwardly from the common base 13 and provides a stop-like member preventing rotation of a detent from one to the other of the longitudinal groove and the locking groove. In effect, the projection 14 acts as a safety device providing a certain resistance to rotational movement which must be overcome before the detent can be moved between the longitudinal groove and the locking groove. The wall defining the surface 4*a* of the locking groove extends substantially radially of the central axis of the first part 1. In the embodiment shown in FIG. 6 a certain amount of play is provided in the disk 11 relative to the configuration of the locking groove and the longitudinal groove. This feature of the disk facilitates its insertion into position within the first part 1. The lugs 15 are provided by deforming the wall surface of the part 1 inwardly.

Figure 7:
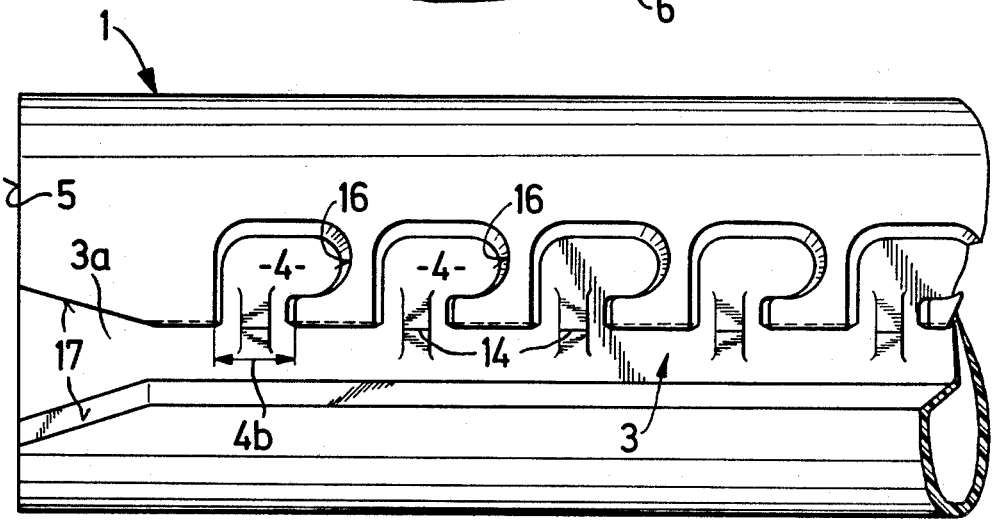
FIG. 7 is a view similar to FIG. 5 of another embodiment of the invention.

Another embodiment of the first part 1 is shown in FIG. 7 with extensions 16 projecting in the axial direction of the first part from the locking grooves 4. By displacing the detents 9 into the extensions 16, after they have been moved into the locking grooves 4 an additional locking action is provided against relative rotational movement between the two parts of the container. Further, as illustrated in FIG. 6, ridge-shaped projections 14 are provided in the common base surface of the longitudinal groove and the locking grooves to ensure that a positive rotational movement is required to effect displacement of the detents between the longitudinal groove and the locking grooves. In this particular arrangement the inlet openings 4*b* to the locking grooves can be slightly larger than the diameter 9*a* of the detents 9, note FIG. 2. Furthermore, to facilitate the lead-in of the detents 9 on the second or outer part 2 into the inlet 3*a* of the longitudinal groove 3 in the first or inner part 1, a dovetailed widening 17 of the inlet is provided at the open end 5 of the first part. This arrangement differs from that shown in FIG. 1 where only one side of the inlet 3*a* had a tapered arrangement.

In FIG. 7A another embodiment of the extensions from the locking groves 4 is illustrated. Unlike the extensions 16 in FIG. 7, the extensions 16A in FIG. 7A extend obliquely to the locking grooves 4. The extensions have a width corresponding to the diameter of the detents 9. After moving the detents into the locking grooves 4 by the combination of a relative longitudinal and rotational movement the detents move into the extensions 16A blocking rotational movement between the first part 1 and the second part 2.

In FIG. 8 the two parts 1, 2 of the container are assembled together and a drilling and milling tool 18 is located within the container. The container is closed at both ends by the closed end 6 of the first part and the closed end 7 of the second part. Three detents 9 are formed in the second part 2 and engage within complementary shaped locking grooves 4 in the first part 1. With the detents held within the locking grooves, the parts of the container are held against being pulled apart in the longitudinal direction. The disk 11 is inserted into the inner part 1 through its open end 5 and is positioned adjacent the closed end 6. Since the disk has a cup-shaped edge or flange the annular disk portion is spaced a certain distance inwardly from the closed end 6. Its central opening 12 corresponds to the cross sectional shape of the object packaged within the container. Shown in FIG. 8, the disk serves to center the outer shaft end of the tool 18 within the container. However, the disk 11 can also be arranged, as indicated in dot-dash lines at a position spaced from both the opened and closed ends of the container. While the cup-shaped configuration of the disk 11 is advantageous, it is not a necessary requirement for the disk. Disks 11 can be used in either of the container parts depending on the type of tool being packaged.

As distinguished from the arrangement shown in FIG. 1 where there is no requirement for spacing between the outer surface of the first part and the inner surface of the second part, in FIG. 8 the inner surface of the outer or second part 2 is spaced radially outwardly from the outer surface of the inner or first place 1 and a collar 19 is formed inwardly at the open end 8 of the second part so that it rides on the outer surface of the inner part. This arrangement facilitates the escape of air from within the container as one part is telescoped into the other and also reduces friction between the two parts of the container.

The container is preferably made of polyethylene and is produced by a blow process. In the formation of the container, the two parts can be produced as a single piece and then separated.

While a specific embodiment of the invention has been shown and described in detail to illustrate the application of the inventive principles, it will be understood that the invention may be embodied otherwise without departing from such principles.

What is claimed is:

1. Container of adjustable length for packing elongated objects of variable lengths, comprising a first elongated cylindrically shaped tubular body and a second elongated cylindrically shaped tubular body, each of said first and second bodies being closed at one end and open at the other end, said first and second bodies arranged to be fitted one into the other in a telescoping fashion and said first and second bodies being rotatable relative to one another about their longitudinal axes, wherein the improvement comprises that the open end of said first body fits within the open end of said second body with its outer surface in juxtaposition to the inner surface of said second body, said first body has a first groove formed inwardly into its outer surface and disposed parallel to its longitudinal axis and extending from its open end toward its closed end, a plurality of second grooves formed inwardly from the outer surface of said first body and extending transversely of and opening from said first groove with said second grooves spaced equidistantly apart along said first groove, said first groove having a pair of longitudinally extending sides and a bottom extending between said sides, said second groove each having a pair of sides and a bottom extending between said sides of said second groove and at least one detent projecting inwardly from the inner surface of said second body adjacent the open end thereof and said detent shaped and arranged to pass in sliding relationship through said first groove in said first body when said first and second bodies are fitted together in a telescoping fashion and upon relative rotation of said first and second bodies about their longitudinal axis to pass into one of said second grooves in interlocking engagement therewith for effecting a locking engagement of said first and second bodies so that a variable overall length of the packing container can be provided by selectively engaging said detent of said second body into one of said second grooves of said first body so that the overall length between the closed ends of said first and second bodies corresponds closely to the length of the object to be packaged, means formed in said first body at the openings between said first groove and said second grooves for providing a resistance for the movement of said detent into and out of said second grooves and said sides and bottom of said second grooves having a shape complementary to the shape of said detent for gripping said detent when it is moved into one of said second grooves.

2. Packing container, as set forth in claim 1, wherein said first groove extends from the open end to the closed end of said first body and said second grooves extend transversely from said first groove along the full length of the first groove.

3. Packing container, as set forth in claim 1, wherein said first groove has an inlet opening at the open end of said first body and the inlet end has a dovetailed configuration converging inwardly into said first groove.

4. Packing container, as set forth in claim 1, wherein said first groove has an inlet opening at the open end of said first body and said first groove at the inlet end thereof has one side disposed parallel to the longitudinal axis of said first body and the opposite side disposed obliquely to said one side and disposed in converging relationship to said one side in the direction toward the closed end of said first body.

5. Packing container, as set forth in claim 1, wherein an annular disk having a central opening therethrough is shaped about its outer circumferential periphery to fit the inner contour of said first body, and said central opening arranged to conform to the lateral configuration of the object to be packed within the container.

6. Packing container, as set forth in claim 1, wherein, a plurality of said detents are formed in and project inwardly from said second body with said detents spaced equidistantly apart at the same spacing as said second grooves, said detents arranged in alignment in the axial direction of said second body for passage through said first groove in said first body.

7. Packing container, as set forth in claim 6, wherein three said detents are formed in said second body.

8. Packing container, as set forth in claim 6, wherein the outer surface of said detents extending inwardly from said second body are circular.

9. Packing container, as set forth in claim 6, wherein said detents are frusto-conical in the direction projecting inwardly from said second body with the outer surface of said detents converging inwardly toward the longitudinal axis of said second body.

10. Packing container, as set forth in claim 6, wherein the opening from each of said second grooves to said first groove is not greater than the maximum diameter of said detents.

11. Packing container, as set forth in claim 6, wherein at the opening from each of said second grooves into said first groove the surfaces defining the opposite sides of the opening and extending transversely of the longitudinal axis of the first groove converge from the edge of said first groove to an apex directed toward the opposite surface of the same said second groove and then diverge into the portion of said second grooves arranged to hold said detents.

12. Packing container, as set forth in claim 6, wherein said second grooves each have an extension from the surface thereof disposed parallel to and spaced laterally from said first groove and width of said extension corresponding to the diameter of said detents so that with said detents located in said first groove upon relative rotation between said first and second bodies said detents enter into said locking grooves and then upon relative longitudinal movement of said first and second bodies said detents enter said extensions whereby relative rotational movement between said first and second bodies is blocked.

13. Packing container, as set forth in claim 6, wherein said second grooves each have an extension from the surface thereof disposed obliquely to said first groove and said extension having a width corresponding to the diameter of said detents so that with said detents located in said first groove upon relative rotation between said first and second bodies said detents enter into said locking grooves and then upon a combination of relative longitudinal and rotational movement said detents enter said extensions whereby relative rotational movement between said first and second bodies is blocked.

14. Container of adjustable length for packing elongated objects of variable lengths, comprising a first elongated cylindrically shaped tubular body and a second elongated cylindrically shaped tubular body, each of said first and second bodies being closed at one end and open at the other end, said first and second bodies arranged to be fitted one into the other in a telescoping fashion and said first and second bodies being rotatable relative to one another about their longitudinal axes, wherein the improvement comprises that the open end of said first body fits within the open end of said second body with its outer surface in juxtaposition to the inner surface of said second body, said first body has a first groove formed inwardly into its outer surface and disposed parallel to its longitudinal axis and extending from its open end toward its closed end, a plurality of second grooves formed inwardly from the outer surface of said first body and extending transversely of and opening from said first groove with said second grooves spaced equidistantly apart along said first groove, said first groove having a pair of longitudinally extending sides and a bottom extending between said sides, said second grooves each having a pair of sides and a bottom extending between said sides of said second groove, and at least one detent projecting inwardly from the inner surface of said second body adjacent the open end thereof and said detent shaped and arranged to pass in sliding relationship through said first groove in said first body when said first and second bodies are fitted together in a telescoping fashion and upon relative rotation of said first and second bodies about their longitudinal axis to pass into one of said second grooves in interlocking engagement therewith for effecting a locking engagement of said first and second bodies so that a variable overall length of the packing container can be provided by selectively engaging said detent of said second body into one of said second grooves of said first body so that the overall length between the closed ends of said first and second bodies corresponds closely to the length of the object to be packaged, means formed in said first body at the openings between said first groove and said second grooves for providing a resistance for the movement of said detent into and out of said second grooves, said sides and bottom of said second grooves having a shape complementary to the shape of said detent for gripping said detent means when it is moved into one of said second grooves, and means located within said first body spaced axially from the open end thereof for laterally positioning an object within the container.

15. Container, as set forth in claim 14, wherein said bottom of said first groove is spaced inwardly from the inner surface of said first body, and the bottom of said first groove and the bottoms of said second grooves forming a continuous surface concentric with the outer surface of said first body.

16. Container, as set forth in claim 15, wherein said first groove having at least one of its longitudinally extending sides tapering inwardly from the open end of said first body for facilitating the introduction of said detent into said first groove.

17. Container, as set forth in claim 15, wherein said means for laterally positioning said object comprising an annular disk having a central opening arranged to receive the object being packaged and having an outer circumferential periphery conforming to the shape of the interior of said first body including the shape of said first groove and said second grooves so that said disk can be inserted into said first body from the open end thereof.

18. Container, as set forth in claim 17, wherein protrusions are formed inwardly in said first body for holding said annular disk in position against displacement toward the open end of said first body.

19. Container, as set forth in claim 17, wherein said annular disk has a cup-shaped flange extending around its outer circumferential periphery and said flange arranged to extend from said annular disk toward and into contact with the closed end of said first body so that said annular disk is spaced from said first body.

20. Container, as set forth in claim 15, wherein the outer surface of said first body is in sliding contact with the inner surface of said second body when said first and second bodies are fitted together in a telescoping fashion.

21. Container, as set forth in claim 15, wherein the outer surface of said first body is spaced inwardly from the inner surface of said second body, and said second body has a collar at its open end with the inner surface of said collar spaced inwardly from the inner surface of said second body so that the inner surface of said collar contacts the outer surface of said first body in sliding relationship.

22. Container, as set forth in claim 15, wherein a plurality of said detents are formed in said second body spaced equidistantly apart at the same spacing as said second grooves with said detents arranged in alignment in the axial direction of said second body for passage through said first groove in said first body.

23. Container, as set forth in claim 22, wherein the surface of said detents extending inwardly from said second body is circular and said circular surfaces are frusto-conically formed converging inwardly from said second body toward the longitudinal axis of said second body.

24. Container, as set forth in claim 15, wherein each of said second grooves has an extension spaced laterally from said first groove and parallel with the longitudinal axis of said first part, and the width and depth of said extension being formed complementary to the corresponding dimensions of said detents and being arranged to receive and secure said detents so that said first and second parts are secured against relative rotation.

25. Container, as set forth in claim 15, wherein said first groove is shaped at its inlet opening at the open end of said first body with at least one side of said first groove converging inwardly from the open end to provide a lead-in arrangement for said detents, the dimension of the inlet opening at the open end being greater than the corresponding dimension in the range of said second grooves.

26. Container, as set forth in claim 15, wherein said means for laterally positioning an object comprises an annular disk having a central opening therethrough and arranged to be positioned within said first body, the outer circumferential periphery of said annular disk having a cut-out to permit its passage around said first and second grooves extending inwardly into said first body, the central opening in said annular disk having a shape arranged to conform to the lateral configuration of the object to be packed within the container.

27. Container, as set forth in claim 15, wherein said means for providing a resistance at the opening between said first groove and said second grooves comprises a ridge-like projection from the common bottom of said first and second grooves.

* * * * *